United States Patent [19]

Baumann

[11] 4,433,611

[45] Feb. 28, 1984

[54] GAS PISTON OPERATED AUTOMATIC HAND WEAPON

[75] Inventor: Jürgen Baumann, Lottstetten, Fed. Rep. of Germany

[73] Assignee: SIG Schweizerische Industrie-Gesellschaft, Nuhausen am Rheinfall, Switzerland

[21] Appl. No.: 328,670

[22] Filed: Dec. 8, 1981

[30] Foreign Application Priority Data

Dec. 30, 1980 [CH] Switzerland ..... 9647/80

[51] Int. Cl.[3] ..... F41D 5/08

[52] U.S. Cl. ..... 89/193

[58] Field of Search ..... 89/193

[56] References Cited

U.S. PATENT DOCUMENTS

| | | | |
|---|---|---|---|
| 1,738,501 | 12/1929 | Moore . | |
| 2,340,293 | 2/1944 | Balleisen | 89/193 |
| 2,409,225 | 10/1946 | Schaich . | |
| 2,715,858 | 8/1955 | Hoppert . | |
| 2,750,849 | 6/1956 | Harvey | 89/193 |
| 2,941,450 | 6/1960 | Crittendon et al. . | |
| 3,715,955 | 2/1973 | Folley et al. | 89/193 |

FOREIGN PATENT DOCUMENTS

| | | |
|---|---|---|
| 721591 | 4/1942 | Fed. Rep. of Germany . |
| 2302785 | 8/1974 | Fed. Rep. of Germany . |

*Primary Examiner*—Stephen C. Bentley

*Attorney, Agent, or Firm*—Spencer & Frank

[57] ABSTRACT

An automatic hand weapon has barrel; a gas cylinder having a work chamber; an inlet channel for introducing propellant gas from the barrel to the work chamber; a gas piston slidably received in the cylinder, whereby the piston executes, from a position of rest, a work stroke for operating breechblock components of the weapon. The piston further has a lateral face which is in sliding engagement with a wall of the cylinder. A first bore is provided through the wall of the cylinder for forming part of the inlet channel. A second bore is provided through the piston. The second bore has a first opening in the lateral face of the piston and a second opening in the end face of the piston. In the position of rest of the piston the first opening of the second bore is in registry with the first bore, whereby the second bore maintains communication between the first bore and the work chamber of the cylinder. There is also provided an outlet channel which maintains communication between the work chamber and the ambient atmosphere during at least one part of the work stroke.

16 Claims, 4 Drawing Figures

GAS PISTON OPERATED AUTOMATIC HAND WEAPON

BACKGROUND OF THE INVENTION

This invention relates to an automatic hand weapon which has a gas tap formed by a radial bore in the barrel and a cylinder which has an inlet channel constituting a continuation of the radial bore and further, a gas piston displaceably received in the cylinder and provided with a return spring for actuating elements of the breechblock.

In automatic hand weapons it is conventional to utilize the pressure of the projectile-propelling gases for actuating the breechblock or components thereof. For tapping such a control pressure which may be as high as 2000 bar, in the front sight support there is provided a nozzle arrangement which communicates with a gas tapping bore in the barrel. A nozzle part which has differently formed grooves and which forms part of the nozzle arrangement is adjustable in such a manner that the gas quantity escaping from the barrel is admitted into one of two passages of different cross sections and affects a piston and a piston rod for actuating the breechblock.

Because of propellant residues which pass with the gas through the nozzle arrangement, even after a few shots substantial soiling of the weapon components may take place. Further, the automatic actuation of the breechblock parts as outlined above is effected non-uniformly: such an actuation depends upon the ammunition fired. Particularly in case of firing rifle grenades with normal ammunition or propellant charges the pressure may increase substantially or may last longer.

After firing, the gas is released to the atmosphere from the nozzle arrangement by means of the closing spring surrounding the piston rod, along the same path back into the barrel and into the atmosphere. A self-cleaning of the various ports and channels which in part are arranged at an angle, cannot be achieved with such a process.

SUMMARY OF THE INVENTION

It is an object of the invention to provide an improved automatic hand weapon in which the above-discussed disadvantages are greatly reduced. In particular, the gas pressure in the piston-and-cylinder arrangement is to vary only between narrow limits in such a manner that the breechblock drive is maintained uniform, the stress on the components is small and further, a self-cleaning of the channels is made possible.

The object and others to become apparent as the specification progresses, are accomplished by the invention, according to which, briefly stated, in the piston there is provided at least one bore whose first opening is, in the position of rest, at least approximately in alignment with the axis of the bore forming the gas tap in the barrel and further, the bore provided in the piston has a second opening which is formed in the end face of the piston and which is in communication with the first opening and further, in the cylinder there is provided at least one discharge channel which, during at least one part of the work stroke of the piston, establishes communication between the cylinder chamber and the ambient atmosphere.

DESCRIPTION OF THE PREFERRED EMBODIMENT

Figure 1:
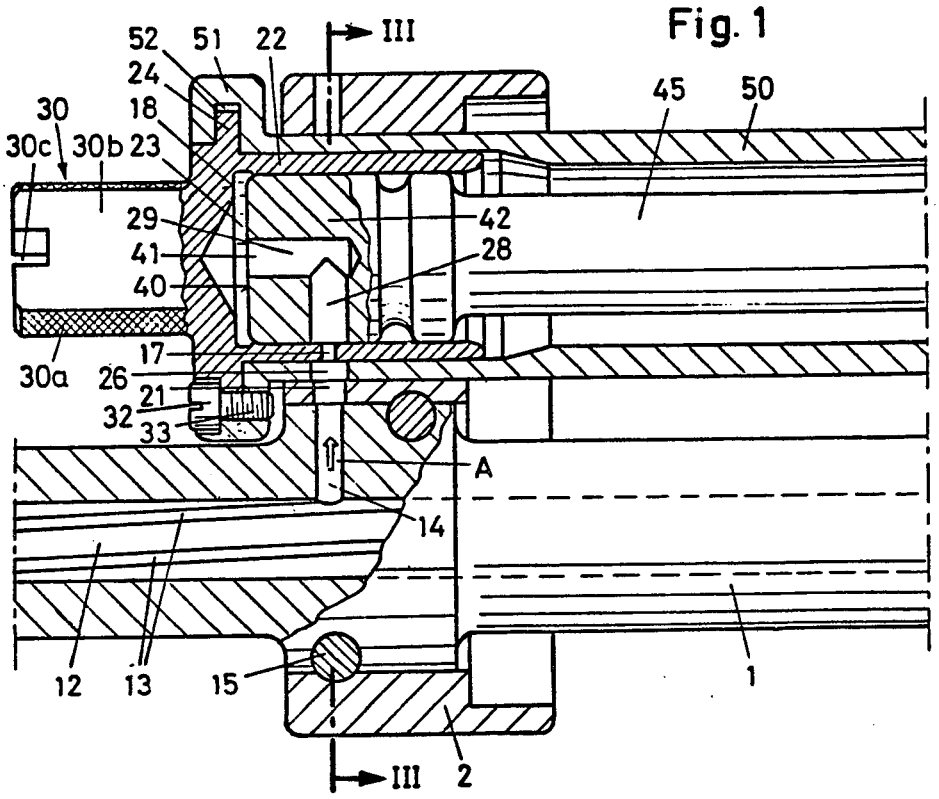
FIG. 1 is an axial sectional view of one part of a hand weapon illustrating a preferred embodiment of the invention in a first setting and showing the gas-operated piston in its position of rest.
Figure 2:
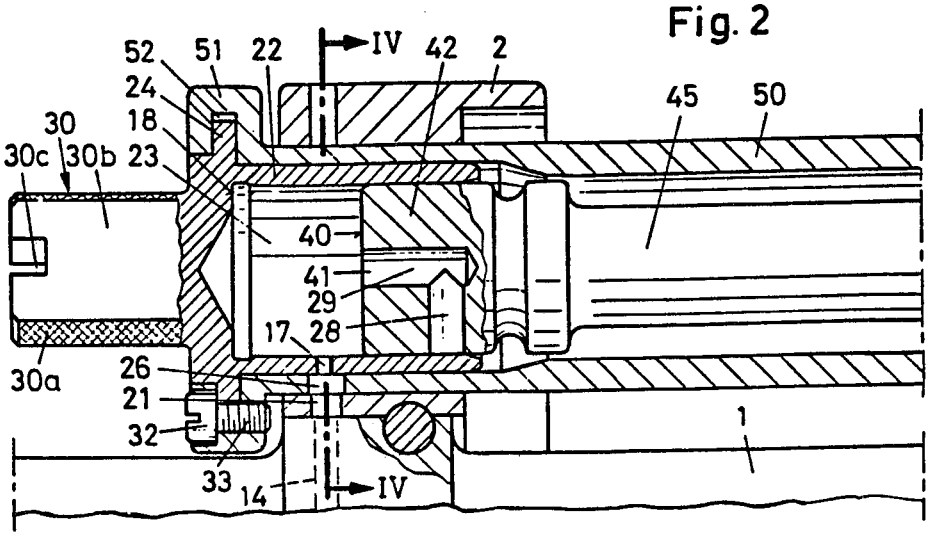
FIG. 2 is an axial sectional view similar to FIG. 1, but showing the gas-operated piston during its work stroke.

Turning first to FIGS. 1 and 2, the barrel 1 of an automatic hand weapon illustrated therein is provided with a radial bore 14 at its forward part, close to the muzzle. In the barrel bore the rifling 12 (elevations) and 13 (grooves) are visible. A nozzle part 2 serves as the front sight support which, however, is not shown and which is of conventional structure. The nozzle part 2 has a bore which is parallel to the barrel 1 and in which there is inserted a cylinder, formed of a cylinder tube 50 and an insert sleeve 22 whose end wall forms the cylinder bottom 18. The nozzle part 2 is prevented from rotation relative to the barrel 1 by means of pins 15.

The nozzle part 2 has a bore 21 and the cylinder tube 50 has a bore 26 which are in alignment with the bore 14 and which, together with the bore 14 form an inlet channel to the cylinder. The insert sleeve 22 is provided with a radial flange 24 which is rotatably supported and guided in a groove portion 52 of a cylinder flange 51 formed at the end of the cylinder tube 50. The insert sleeve 22 carries, on its portion projecting rearwardly from the cylinder tube 50, a setting knob 30 which has two parallel-arranged lateral flattened portions **30*b* and is knurled at 30*a* on the remainder of its circumference. At its end face the setting knob 30 has a slot 30*c* for receiving a screwdriver edge. By virtue of this arrangement the insert sleeve 22 can be adjusted (turned) externally with respect to the cylinder tube 50. By means of a setscrew 32 which is held in a thread 33 of the cylinder tube 50 the insert sleeve 22 can be immobilized in one of two positions designated by markings I and II designated at 31 (FIGS. 3 and 4**).

Figure 3:
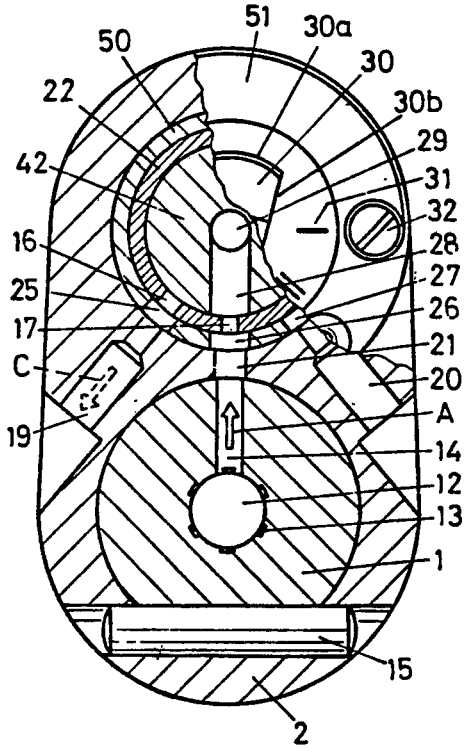
FIG. 3 is a sectional view taken along line III—III of FIG. 1.
Figure 4:
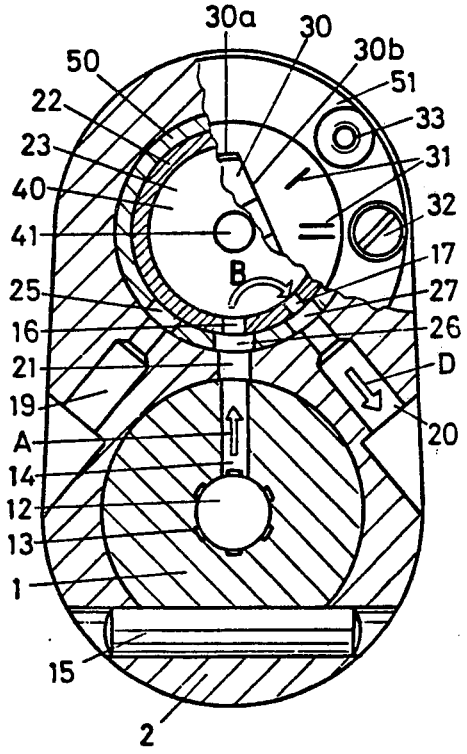
FIG. 4 is a sectional view similar to FIG. 3, but showing the preferred embodiment in a second setting and illustrating the gas-operated piston during its work stroke.

Turning now in particular to FIGS. 3 and 4, the insert sleeve 22 has two radial ports 16 and 17; the port 16 having a greater diameter than the port 17. In the nozzle part 2 there are provided two bores 19 and 20 which communicate with the atmosphere laterally of the barrel 1 and whose axes are situated in a single plane which extends perpendicularly to the barrel axis and the axis of the cylinder tube 50. The axes of the bores 19, 20 intersect at least approximately on the axis of the cylinder tube 50. Similarly, the axes of the ports 16 and 17 extend in the same plane and intersect, at least approximately, on the cylinder tube axis. The angle between the two axes of the ports 16 and 17 in the insert sleeve 22 is one half the angle between the axes of the bores 19 and 20 provided in the nozzle part 2. The bores 19 and 20 are divergent with respect to one another as viewed from the cylinder tube 50 and are oriented approximately tangentially to, and on either side of, the weapon barrel 1.

In the gas cylinder formed by the cylinder tube 50 and the insert sleeve 22 there is received an axially displaceable piston 42 which is rigidly secured to a piston rod 45, whereby motions of the piston 42 are transmitted in a conventional manner to the breechblock or its elements (not shown). The piston 42 is provided with a radial bore 28 which, in the position shown in FIGS. 1 and 3, is in alignment with the inlet channel formed by bores 14, 21, 26 and 17. An axial bore 29 provided in the piston 42 and having an opening 41, maintains communication between the radial bore 28 and a cylinder chamber 23.

The cylinder tube 50 has three bores 25, 26 and 27 whose axes lie in the same plane which contains the axes of bores 16, 17, 19 and 20. The axes of bores 25, 26 and 27 intersect at least approximately on the axis of the cylinder tube 50. The axes of each two adjoining bores 25, 26 and 26, 27, respectively, define identical angles which are of the same magnitude as the angle defined between the axes of the ports 16 and 17 provided in the insert sleeve 22. Accordingly, the axes of the two flanking bores 25 and 27 intersect at the same angle as the axes of the bores 19 and 20 provided in the nozzle part 2. It is noted that the port 16 has a diameter that is larger than the diameter of the port 17, but is, at the most, identical to the diameter of the bore 25 or 27. Also, the bores 25 and 27 are arranged symmetrically to one another with respect to a single plane in which lie the longitudinal axes of the cylinder tube 50 and the barrel 1.

After releasing the setscrew 32, the insert sleeve 22 can be turned, for example, by inserting a screwdriver-type tool into the slot 30*c* of the knob 30, into a first operational position I shown in FIGS. 1, 2 and 3 or into a second operational position II shown in FIG. 4.

When the insert sleeve 22 is in position I (FIGS. 1, 2 and 3), the bores 14, 21, 26, 17, 28 and 29 form a gas inlet channel from the barrel bore 12 to the cylinder chamber 23 and further, the bores 16, 25 and 19 form an outlet channel from the cylinder chamber 23 to the atmosphere. When the insert sleeve 22 is set to position II (FIG. 4), the bores 14, 21, 26, 16, 28 and 29 form a gas inlet channel whereas the bores 17, 27 and 20 form an outlet channel. The purpose of the different settings I and II will become apparent as the specification progresses.

In the description which follows, the mode of operation of the above-described structure will be set forth. First the functioning in setting I of the insert sleeve 22 (FIGS. 1, 2 and 3) will be explained.

At the moment of firing a round, the gas piston 42 is in its rearward position of rest as shown in FIGS. 1 and 3. As the projectile in the barrel bore 12 passes the radial bore 14, pressurized propellant gases enter the bore 14 in the direction of arrow A and then pass consecutively through the bores 21, 26 and 17 and then enter the radial piston bore 28, the axial piston bore 29 and are ultimately admitted to the cylinder work chamber 23.

The pressure thus generated in the work chamber 23 displaces the piston 42 towards the right from its position shown in FIG. 1 into its position shown in FIG. 2. As such displacement (work stroke) of the piston 42 takes place, the radial bore 28 of the piston 42 moves out of alignment with the bore 17 in the insert sleeve 22 and, as a result, the inflow of gas in the direction of arrow A is interrupted by the piston land. The arrangement described above which thus provides for a cutoff of the pressurized intake gases through the piston bores 28 and 29 has the result that practically always the same gas quantities at practically the same pressure are admitted into the cylinder chamber 23 for causing the piston 42 to execute its work stroke.

As the end face 40 of the cylinder 42 has, during the working stroke of the piston 42, cleared the bore 17, communication between the bore 14 and the cylinder work chamber 23 is reestablished. At the same time, the end face 40 of the piston 42 has moved away from the outlet channel formed of bores 16, 25 and 19. Thus, the compressed gases in the cylinder chamber 23 may flow out into the atmosphere in the direction of the arrow C (FIG. 3) from the cylinder chamber 23 and, at the same time, perform a cleaning of the bore 16. It is noted that in FIG. 3 the arrow C is shown in phantom lines because in the position of the piston 42 depicted in FIG. 3 the outlet channel formed by bores 16, 25, and 19 is still blocked.

As noted above, in FIGS. 1, 2 and 3, the insert sleeve 22 is in setting I, thus the smaller bore 17 is part of the inlet channel while the larger bore 16 is part of the outlet channel. This position is preferred in weapons which have just been cleaned.

Turning now to the sectional FIG. 4 (which shows the gas piston 42 away from its position of rest), it is seen that the insert sleeve 22 has been rotated counterclockwise from its position shown in FIG. 3, from position I to position II. In position II the larger bore 16 is part of the inlet channel whereas the smaller bore 17 is part of the outlet channel. In this manner, as compared to the arrangement of FIGS. 1, 2 and 3, a larger gas quantity is introduced into the cylinder chamber 23 in the direction of the arrow A and, as a result, a greater opening energy is released to operate with more ease the breechblock system which may be soiled. In FIG. 4 there is depicted the operational phase when residual propelling gases enter in the direction of arrow A into the cylinder work chamber 23 but are immediately released therefrom through the outlet channel formed of bores 17, 27 and 20. In FIG. 4 the gas flow is indicated with arrows A, B and D.

For returning the piston 42 into its position of rest, there is provided a closing spring (not shown) on the piston rod 45. During the period the piston 42 blocks the outlet channel, the residual gas is driven back into the barrel 1 from the cylinder chamber 23 through the inlet channel.

It will be understood that the above description of the present invention is susceptible to various modifications, changes and adaptations, and the same are intended to be comprehended within the meaning and range of equivalents of the appended claims.

I claim:

1. An automatic hand weapon comprising:

(a) a barrel having a longitudinal barrel bore for guiding a projectile;

(b) a gas cylinder tube mounted on said barrel and having a work chamber;

(c) inlet channel means for introducing propellant gas from said barrel bore to the work chamber;

(d) outlet channel means comprising separate first and second outlet channels for discharging propellant gas from the work chamber into the ambient atmosphere;

(e) an insert sleeve rotatably supported within said cylinder tube and defining said work chamber; said insert sleeve having (1) first and second circumferentially spaced ports of unlike diameters;

(2) a first angular position in which said second port forms part of said inlet channel means and said first port is in registry with said first outlet channel for connecting said first outlet channel with said work chamber;

(3) a second angular position in which said first port forms part of said inlet channel means and said second port is in registry with said second outlet channel for connecting said second outlet channel with said work chamber;

(f) setting means for arbitrarily moving said insert sleeve into one of said angular positions; and (g) a gas piston slidably received in said insert sleeve for executing work strokes from a position of rest for operating breechblock components of the weapon; said piston maintaining communication between said work chamber and the ambient atmosphere through said outlet channel means during at least one part of each work stroke; said gas piston having (1) an end face exposed to the gas pressure in said work chamber, whereby a force is imparted to said piston for executing the work strokes;

(2) a lateral face being in a sliding engagement with a wall of said insert sleeve; and (3) a piston bore provided through said piston and having a first opening in said lateral face and a second opening in said end face; in said position of rest of said piston said first opening being in registry with said inlet channel means whereby said piston bore maintains communication between said inlet channel means and said work chamber in said position of rest.

2. An automatic hand weapon as defined in claim 1, wherein said position of rest of said piston is a first piston position; said piston further having a second and a third piston position it assumes consecutively during each work stroke; said first opening of said piston bore being out of registry with said inlet channel means as said piston has reached said second piston position, whereby said lateral wall of said piston covers said inlet channel means beyond said second piston position; said end face of said piston clearing said inlet channel means as said piston has reached said third piston position, whereby said inlet channel means is in direct communication with said work chamber in and beyond said third piston position; said first and second ports of said insert sleeve being arranged in a common radial plane thereof, whereby said outlet channel means establishes communication between said work chamber and the ambient atmosphere only in and beyond said third piston position.

3. An automatic hand weapon as defined in claim 1, further wherein said barrel has a muzzle and said inlet channel means communicating with said barrel bore in the vicinity of said muzzle.

4. An automatic hand weapon as defined in claim 1, wherein said cylinder tube has first, second and third circumferentially spaced ports; said first and second ports of said cylinder tube being in continuous communication with said first and second outlet channels, respectively, and said third port of said cylinder tube being in continuous communication with said inlet channel means and being situated between said first and second ports of said cylinder tube; in said first angular position of said insert sleeve said second port of said insert sleeve being in registry with said third port of said cylinder tube and said first port of said insert sleeve being in registry with said first port of said cylinder tube and in said second angular position of said insert sleeve said second port of said insert sleeve being in registry with said second port of said cylinder tube and said first port of said insert sleeve being in registry with said third port of said cylinder tube.

5. An automatic hand weapon as defined in claim 4, wherein the angle between the first and second ports of said cylinder tube is twice the angle between the first and second ports of said insert sleeve.

6. An automatic hand weapon as defined in claim 4, wherein said first and second ports of said cylinder tube are symmetrically arranged with respect to a single plane containing the longitudinal axes of said barrel and said cylinder tube.

7. An automatic hand weapon as defined in claim 4 wherein the larger diameter of said ports of said insert sleeve is at the most identical to the diameter of said first and second ports of said cylinder tube.

8. An automatic hand weapon as defined in claim 4, further comprising a nozzle part mounted on said barrel in the vicinity of the muzzle thereof; said cylinder tube and said insert sleeve being surrounded by said nozzle part; said first and second outlet channels being provided in said nozzle part and extending in a divergent orientation with respect to one another as viewed from said cylinder tube.

9. An automatic hand weapon as defined in claim 8, wherein said outlet channels extend at least approximately tangentially to said barrel.

10. An automatic hand weapon as defined in claim 1, wherein said setting means comprises manually operable locking means for immobilizing said insert sleeve in one of its said angular positions.

11. An automatic hand weapon comprising:

(a) a barrel having a longitudinal barrel bore for guiding a projectile;

(b) a gas cylinder tube mounted on said barrel and having a work chamber;

(c) inlet channel means for introducing propellant gas from said barrel bore to the work chamber;

(d) outlet channel means for discharging propellant gas from the work chamber into the ambient atmosphere;

(e) an insert sleeve rotatably supported within said cylinder tube and defining said work chamber; said insert sleeve having (1) first and second circumferentially spaced ports of unlike diameters;

(2) a first angular position in which said second port forms part of said inlet channel means and said first port is in registry with said outlet channel means for connecting said outlet channel means with said work chamber;

(3) a second angular position in which said first port forms part of said inlet channel means and said second port is in registry with said outlet channel means for connecting said outlet channel means with said work chamber;

(f) externally exposed and externally readily accessible setting means operatively connected with said insert sleeve for arbitrarily moving said insert sleeve into one of said angular positions; and (g) a gas piston slidably received in said insert sleeve for executing work strokes from a position of rest for operating breechblock components of the weapon; said piston maintaining communication between said work chamber and the ambient atmosphere through said outlet channel means during at least one part of each work stroke; said gas piston having (1) an end face exposed to the gas pressure in said work chamber, whereby a force is imparted to said piston for executing the work strokes;

(2) a lateral face being in a sliding engagement with a wall of said insert sleeve; and (3) a piston bore provided through said piston and having a first opening in said lateral face and a second opening in said end face; in said position of rest of said piston said first opening being in registry with said inlet channel means whereby said piston bore maintains communication between said inlet channel means and said work chamber in said position of rest.

12. An automatic hand weapon as defined in claim 11, wherein said position of rest of said piston is a first piston position; said piston further having a second and a third piston position it assumes consecutively during each work stroke; said first opening of said piston bore being out of registry with said inlet channel means as said piston has reached said second piston position, whereby said lateral wall of said piston covers said inlet channel means beyond said second piston position; said end face of said piston clearing said inlet channel means as said piston has reached said third piston position, whereby said inlet channel means is in direct communication with said work chamber in and beyond said third piston position; said first and second ports of said insert sleeve being arranged in a common radial plane thereof, whereby said outlet channel means establishes communication between said work chamber and the ambient atmosphere only in and beyond said third piston position.

13. An automatic hand weapon as defined in claim 11, further wherein said barrel has a muzzle and said inlet channel means communicating with said barrel bore in the vicinity of said muzzle.

14. An automatic hand weapon comprising:

(a) a barrel having a longitudinal barrel bore for guiding a projectile;

(b) a gas cylinder tube mounted on said barrel and having a work chamber;

(c) inlet channel means for introducing propellant gas from said barrel bore to the work chamber;

(d) outlet channel means for discharging propellant gas from the work chamber into the ambient atmosphere;

(e) an insert sleeve rotatably supported within said cylinder tube and defining said work chamber; said insert sleeve having circumferentially spaced ports of unlike diameters;

(f) externally exposed and externally readily accessible setting means operatively connected with said insert sleeve for arbitrarily moving said insert sleeve into a plurality of angular positions for arbitrarily aligning selected ones of said ports with said inlet channel means and said outlet channel means to vary effective cross-sectional areas thereof; and (g) a gas piston slidably received in said insert sleeve for executing work strokes from a position of rest for operating breechblock components of the weapon; said piston maintaining communication between said work chamber and the ambient atmosphere through said outlet channel means during at least one part of each work stroke; said gas piston having (1) an end face exposed to the gas pressure in said work chamber, whereby a force is imparted to said piston for executing the work strokes;

(2) a lateral face being in a sliding engagement with a wall of said insert sleeve; and (3) a piston bore provided through said piston and having a first opening in said lateral face and a second opening in said end face; in said position of rest of said piston said first opening being in registry with said inlet channel means whereby said piston bore maintains communication between said inlet channel means and said work chamber in said position of rest.

15. An automatic hand weapon as defined in claim 14, wherein said position of rest of said piston is a first piston position; said piston further having a second and a third piston position it assumes consecutively during each work stroke; said first opening of said piston bore being out of registry with said inlet channel means as said piston has reached said second piston position, whereby said lateral wall of said piston covers said inlet channel means beyond said second piston position; said end face of said piston clearing said inlet channel means as said piston has reached said third piston position, whereby said inlet channel means is in direct communication with said work chamber in and beyond said third piston position; said ports of said insert sleeve being arranged in a common radial plane thereof, whereby said outlet channel means establishes communication between said work chamber and the ambient atmosphere only in and beyond said third piston position.

16. An automatic hand weapon as defined in claim 14, further wherein said barrel has a muzzle and said inlet channel means communicating with said barrel bore in the vicinity of said muzzle.

* * * * *